US011306942B2

(12) United States Patent
Steffes et al.

(10) Patent No.: US 11,306,942 B2
(45) Date of Patent: Apr. 19, 2022

(54) HEAT PUMP WATER HEATER

(71) Applicant: Steffes Corporation, Dickinson, ND (US)

(72) Inventors: Thomas P. Steffes, Dickinson, ND (US); Paul J. Steffes, Dickinson, ND (US); Austin P. Zeller, Dickinson, ND (US); Joshua P. Vetter, Dickinson, ND (US)

(73) Assignee: Steffes Corporation, Dickinson, ND (US)

( * ) Notice: Subject to any disclaimer, the term of this patent is extended or adjusted under 35 U.S.C. 154(b) by 183 days.

(21) Appl. No.: 16/532,752

(22) Filed: Aug. 6, 2019

(65) Prior Publication Data

US 2021/0041142 A1 Feb. 11, 2021

(51) Int. Cl.

| | |
|---|---|
| ***F24H 4/02*** | (2006.01) |
| ***F24H 9/20*** | (2022.01) |
| ***F25B 30/02*** | (2006.01) |
| ***F25B 41/20*** | (2021.01) |

(52) U.S. Cl.

CPC ..... *F24H 4/02* (2013.01); *F24H 9/2007* (2013.01); *F25B 30/02* (2013.01); *F25B 41/20* (2021.01)

(58) Field of Classification Search

CPC ..... F24H 4/02; F24H 9/2007; F25B 41/20; F25B 30/02; F25B 6/04; F25B 2339/047; F25B 2600/2501; F25B 2600/2507; F25B 2400/0403; F25B 6/02; F25B 39/04

See application file for complete search history.

(56) References Cited

U.S. PATENT DOCUMENTS

| | | | | |
|---|---|---|---|---|
| 5,379,832 | A | 1/1995 | Dempsey | |
| 2016/0097546 | A1* | 4/2016 | Tsai | F24D 17/02 122/14.1 |
| 2016/0138830 | A1 | 5/2016 | Lesage et al. | |

FOREIGN PATENT DOCUMENTS

| | | | |
|---|---|---|---|
| CN | 2935007 Y | * | 8/2007 |
| CN | 204478484 U | * | 7/2015 |
| CN | 108361984 A | * | 8/2018 |

OTHER PUBLICATIONS

Jie et al., Instant Heat Pump Water Heater System, Aug. 3, 2018, CN108361984A, Whole Document (Year: 2018).*

(Continued)

*Primary Examiner* — Larry L Furdge

(74) *Attorney, Agent, or Firm* — Brian D. Kaul; Westman, Champlin & Koehler, P.A.

(57) ABSTRACT

A heat pump water heater includes a tank, a first condenser, a second condenser, a heat pump, valving and a controller. The tank includes an interior cavity, an input port and an output port. The first condenser and second condenser each include an input port and an output port. The heat pump drives a fluid in a heated state through an output. A first setting of the valving fluidically couples the heat pump output to the input port of the first condenser, and fluidically disconnects the heat pump output from the input port of the second condenser. A second setting of the valving fluidically couples the heat pump output to the input port of the second condenser, and fluidically disconnects the heat pump output from the input port of the first condenser. The controller selectively directs the valving to the first or second setting.

8 Claims, 5 Drawing Sheets

(56) References Cited

OTHER PUBLICATIONS

Huang, Variable Capacity Heat Pump Water Heater, Aug. 15, 2007, CN2935007Y, Whole Document (Year: 2007).*
Han et al., China Water Heater, Jul. 15, 2015, CN204478484U, Whole Document (Year: 2015).*
Shapiro, Carl, and Puttagunta, Srikanth "Field Performance of Heat Pump Water Heaters in the Northeast". United States. doi:10.2172/1238325. https://www.osti.gov/servlets/purl/1238325. (66 pages).
Examination Search Report for Canadian Patent Application No. 3,083,450, dated Jun. 28, 2021.

* cited by examiner

HEAT PUMP WATER HEATER

FIELD

Embodiments of the present disclosure are generally directed to heat pump water heaters and, more specifically, to a heat pump water heater having dual condensers.

BACKGROUND

Conventional heat pump water heaters utilize a combination of a heat pump and electric water heating elements to heat water contained in a tank. The heat pump component generally utilizes electricity to move heat generated through a reverse refrigeration process to the water. The electric water heating elements, such as resistive heating elements, are positioned within the tank to heat the water.

SUMMARY

Embodiments of the present disclosure generally relate to heat pump water heaters that utilize a heat pump to heat water contained in a tank. In one embodiment, the heat pump water heater includes a tank, a first condenser, a second condenser, a heat pump, valving and a controller. The tank includes an input port, through which water is input to an interior cavity of the tank, and an output port, through which water is discharged from the interior cavity. The first condenser is configured to heat an upper portion of the interior cavity and includes an input port and an output port. The second condenser is configured to heat a lower portion of the interior cavity and includes an input port and an output port. The heat pump is configured to drive a fluid in a heated state through a heat pump output and receive the fluid through a heat pump input. The valving has a first valve setting, in which the heat pump output is fluidically coupled to the input port of the first condenser, and the heat pump output is fluidically disconnected from the input port of the second condenser. The valving also has a second valve setting, in which the heat pump output is fluidically coupled to the input port of the second condenser, and the heat pump output is fluidically disconnected from the input port of the first condenser. The controller is configured to selectively direct the valving to the first or second valve setting.

Another embodiment of the heat pump water heater includes a tank, a first condenser, a second condenser, a heat pump, valving and a controller. The tank includes an input port, through which water is input to an interior cavity of the tank, and an output port, through which water is discharged from the interior cavity. The first condenser is configured to heat an upper portion of the interior cavity and includes first and second ports. The second condenser is configured to heat a lower portion of the interior cavity and includes a first port, and a second port fluidically coupled to the second port of the first condenser. The heat pump is configured to drive a fluid in a heated state through a heat pump output and receive the fluid through a heat pump input. The valving has a first valve setting, in which the heat pump output is fluidically coupled to the first port of the first condenser and the heat pump input is fluidically coupled to the first port of the second condenser, and a second valve setting, in which the heat pump output is fluidically coupled to the first port of the second condenser and the heat pump input is fluidically connected to the first port of the first condenser. The controller is configured to selectively direct the valving to the first or second valve setting.

In yet another embodiment, the heat pump water heater includes a tank, a first condenser, a second condenser, a heat pump, valving, a first temperature sensor and/or a second temperature sensor, and a controller. The tank includes an input port, through which water is input to an interior cavity of the tank, and an output port, through which water is discharged from the interior cavity. The first condenser includes a first section of tubing configured to heat an upper portion of the interior cavity, the first section of tubing having an input port and an output port. The second condenser includes a second section of tubing configured to heat a lower portion of the interior cavity that is displaced from the upper portion along a central axis, the second section of tubing having an input port and an output port. The heat pump is configured to drive a fluid in a heated state through a heat pump output and receive the fluid through a heat pump input. The valving has a first valve setting, in which the heat pump output is fluidically coupled to the input port of the first section of tubing and the heat pump output is fluidically disconnected from the input port of the second section of tubing, and a second valve setting, in which the heat pump output is fluidically coupled to the input port of the second section of tubing and the heat pump output is fluidically disconnected from the input port of the first section of tubing. The first temperature sensor is configured to generate a first temperature signal indicative of a temperature of water contained in the upper portion of the interior cavity. The second temperature sensor is configured to generate a second temperature signal indicative of a temperature of water contained in the lower portion of the interior cavity. The controller is configured to selectively direct the valving to the first or second valve setting based on the first temperature signal and/or the second temperature signal.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the Background.

DETAILED DESCRIPTION OF ILLUSTRATIVE EMBODIMENTS

Figure 1:
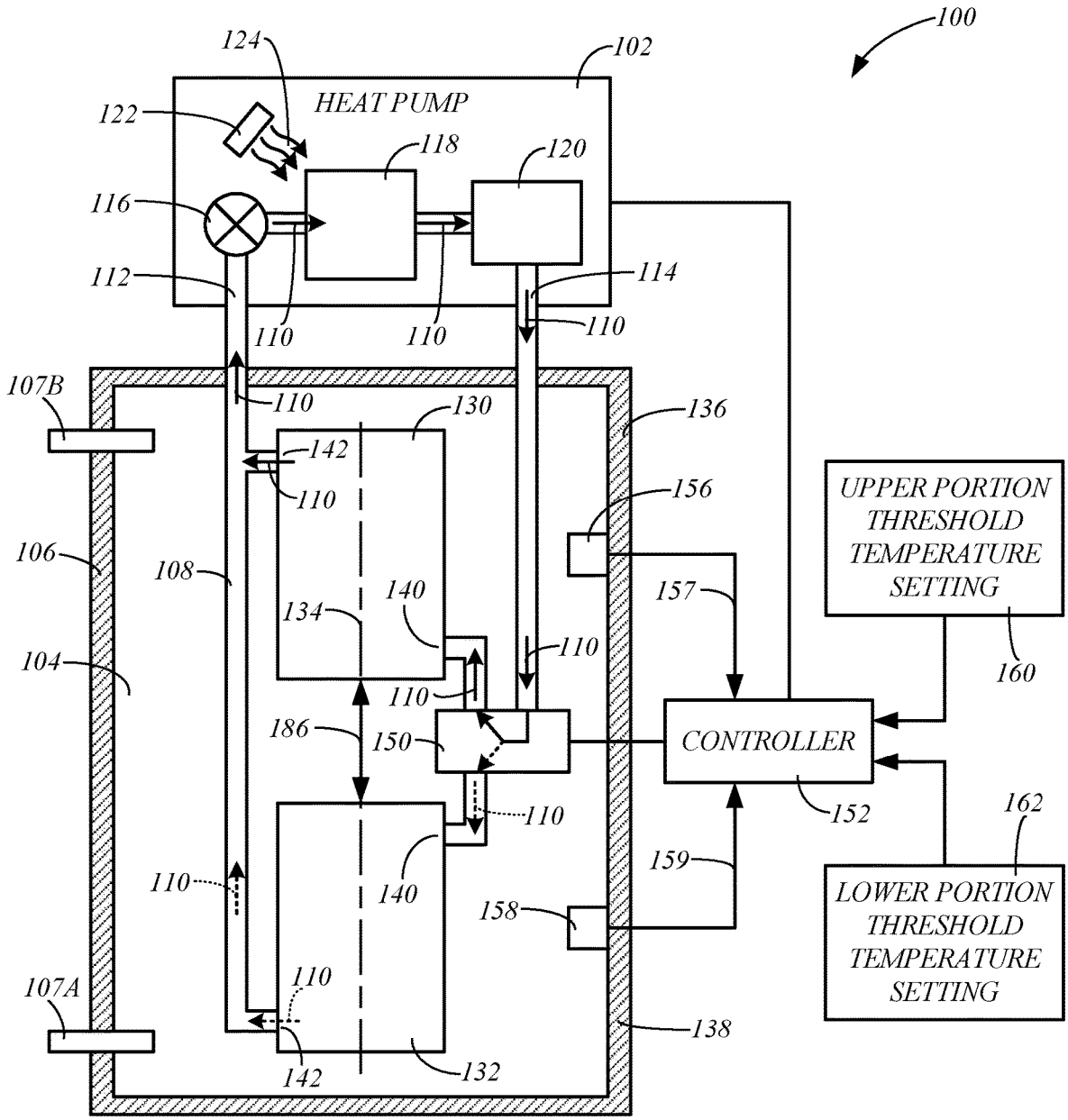
FIG. 1 is a simplified diagram of an exemplary heat pump water heater, in accordance with embodiments of the present disclosure.

Embodiments of the present disclosure are described more fully hereinafter with reference to the accompanying drawings. Elements that are identified using the same or similar reference characters refer to the same or similar elements. The various embodiments of the present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art.

Computer program or software aspects of embodiments of the present disclosure may comprise computer readable instructions or code stored in a computer readable medium or memory. Execution of the program instructions by one or more processors (e.g., central processing unit or controller) results in the one or more processors performing one or more functions or method steps described herein. Any suitable patent subject matter eligible computer readable media or memory may be utilized including, for example, hard disks, CD-ROMs, optical storage devices, or magnetic storage devices. Such computer readable media or memory do not include transitory waves or signals.

Embodiments of the present disclosure generally relate to heat pump water heaters that utilize a heat pump to heat water contained in a tank. FIG. 1 is a simplified diagram of an exemplary heat pump water heater 100, in accordance with embodiments of the present disclosure. The water heater 100 includes a heat pump 102 that is configured to heat water contained in an interior cavity 104 of a tank 106. The tank 106 includes an input port 107A through which water may be added to the tank 106, and an output port 107B, through which water may be discharged from the tank 106 for use. As with conventional water heaters, the water pressure at the input port 107A may be used to pressurize the water contained in the interior cavity 104 and drive the water through the output port 107B.

The heat pump 102 may take on any suitable form, such as, for example, an air-source heat pump, a geothermal heat pump, an absorption-style heat pump, or another suitable heat pump. In the example shown in FIG. 1, the heat pump 102 is in the form of an air-source heat pump that is configured to circulate a fluid (e.g., refrigerant) through a closed circuit 108, as represented by arrows 110. The heat pump 102 receives the fluid flow 110 in a relatively cool state (e.g., liquid state) at an input 112 and discharges the fluid flow 110 in a relatively heated state (e.g., vaporized state) through an output 114. The heated fluid flow 110 travels through the interior cavity 104 to heat the water contained therein.

In some embodiments, the heat pump 102 includes an expansion valve 116, an evaporator 118 and a compressor 120. The expansion valve 116 produces a pressure drop in the circuit 108 that reduces the temperature and pressure of the fluid flow 110. A fan 122 may pass ambient air 124 over the evaporator 118 to transfer heat to the fluid flow 110, which boils and evaporates the fluid into a vapor state. The vaporized fluid flow 110 travels to the compressor 120, which increases the temperature and pressure of the vapor. The fluid circuit 108 delivers the heated vapor fluid flow 110 from the output 114 through the interior cavity 104 of the tank 106 where it is used to heat the water contained therein, as discussed in greater detail below.

In some embodiments, the water heater 100 includes an upper condenser 130 and a lower condenser 132. The upper condenser 130 is configured to heat water contained in an upper portion 136 of the interior cavity 104 of the tank 106, and the lower condenser 132 is configured to heat water contained in a lower portion 138 of the interior cavity 104 of the tank, which is displaced from the upper portion 136 along a central axis 134. In some embodiments, the condensers 130 and 132 are positioned within the interior cavity 104, as indicated in FIG. 1. Alternatively, the condensers 130 and 132 may be positioned outside the tank wall forming the interior cavity 104 and, thus, heat the water contained in the interior cavity 104 through the wall of the tank 106.

Each of the condensers 130 and 132 is configured to receive the fluid flow 110 at an input port 140 and discharge the fluid flow 110 through an output port 142. As the fluid flow 110 travels through the condensers 130 and 132, heat is transferred from the fluid flow 110 to the water contained within the cavity 104. The circuit 108 and the condensers 130 and 132 may include suitable check valves to prevent undesired back flow of the fluid flow 110. For example, check valves may be positioned at the ports 140 or 142 to prevent the fluid flow 110 from traveling back through the ports 140 and 142.

The condensers 130 and 132 may take on any suitable form. For example, the condensers 130 and 132 may include thermally conductive tubing that transfers heat from the fluid flow 110 to the water contained in the interior cavity 104 as the fluid flow 110 travels from the port 140 to the port 142 of the tubing. The heat transfer between the fluid flow 110 and the water contained in the cavity 104 using the condenser 130 or the condenser 132 causes the vapor fluid flow 110 to cool and condense to a liquid, which may be discharged through the port 142 and returned to the input 112 of the heat pump 102 for reheating in accordance with the reverse refrigeration cycle.

In some embodiments, the water heater 100 includes valving 150 that is configured to selectively direct the fluid flow 110 received from the output 114 of the heat pump 102 to the condenser 130 and/or the condenser 132. The valving 150 may be configured to simultaneously direct a fluid flow 110 to both the condenser 130 and the condenser 132. In some embodiments, the valving 150 is configured to selectively direct a fluid flow 110 to either the condenser 130, as indicated by the solid fluid flow arrows 110, or the condenser 132, as indicated by the dashed fluid flow arrows 110. That is, the valving 150 has a first setting, in which the output 114 of the heat pump 102 is fluidically coupled to the port 140 of the condenser 130, and the output 114 of the heat pump 102 is fluidically disconnected from the port 140 of the condenser 132, as indicated by the solid arrows in FIG. 1. The valving 150 also includes a second setting, in which the output 114 of the heat pump 102 is fluidically coupled to the port 140 of the condenser 132, and the output 114 of the heat pump 102 is fluidically disconnected from the port 140 of the condenser 130, as indicated by the dashed lines in FIG. 1. As a result, when the valving 150 is in the first setting, active heat transfer occurs between the fluid flow 110 and the water contained in the upper portion 136 of the tank 106 using the upper condenser 130, while only passive heat transfer (minimal or none) may occur between the stagnant fluid 110 contained within the lower condenser 132 and the water contained within the lower portion 138 of the tank 106. When the valving 150 is in the second setting, the fluid flow 110 travels from the output 114 of the heat pump 102 to the port 140 of the lower condenser 132, and active heat transfer occurs between the fluid 110 flowing through the lower condenser 132 and the water contained in the lower portion 138 of the tank 106, while only passive heat transfer (minimal or none) may occur between the stagnant fluid 110 within the upper condenser 130 and the water contained in the upper portion 136 of the tank 106. Thus, the water heater 100 generally operates to heat the water in the upper portion 136 of the cavity 104 when the valving is in the first setting, and heats the water contained in the lower portion 138 of the cavity 104 when the valving 150 is in the second setting.

In some embodiments, the water heater 100 includes a controller 152, which represents one or more processors that control components of the water heater 100, such as the valving 150 and the heat pump 102 (e.g., the compressor 120, the fan 122, etc.) to perform one or more functions described herein in response to the execution of instructions, which may be stored locally in memory of the water heater 100 or in memory that is remote from the water heater 100. In some embodiments, the processor or processors of the controller 152 are components of one or more computer-based systems. In some embodiments, the controller 152 includes one or more control circuits, microprocessor-based engine control systems, one or more programmable hardware components, such as a field programmable gate array (FPGA), that are used to control components of the water heater 100 to perform one or more functions described herein.

In some embodiments, the controller 152 is configured to control the valving 150 and direct the valving 150 into a desired setting. Thus, the controller 152 may selectively direct the valving 150 to the first setting or the second setting. In some embodiments, the controller 152 directs the valving 150 to the first or second setting based upon a temperature of the water contained in the upper portion 136 of the tank and/or a temperature of the water contained in the lower portion 138 of the tank 106. In accordance with this embodiment, the water heater 100 includes a temperature sensor 156 that is configured to generate a temperature signal 157 that is indicative of a temperature of water contained in the upper portion 136 of the tank 106, and/or a lower temperature sensor 158 that is configured to generate a temperature signal 159 that is indicative of a temperature of water contained in the lower portion 138 of the tank 106. In some embodiments, the controller 152 directs the valving 150 to either the first setting or the second setting based upon the temperature signals 157 and/or 159.

The temperature sensors 156 and 158 may take on any suitable form. In some embodiments, the sensors 156 and 158 may be contained within the interior cavity 104 of the tank 106 as indicated in FIG. 1, or positioned on an exterior side of the tank 106, such as between the exterior of the tank 106 and insulation (not shown), for example.

With the heat pump 102 operating, the controller 152 may control the valving 150 based on the temperature signals 157 and/or 159 in accordance with a heating protocol. In one exemplary embodiment, the controller 152 directs the valving 150 to the first setting to heat the water contained in the upper portion 136 of the tank 106 using the upper condenser 130 when the temperature indicated by the signal 157 output from the temperature sensor 156 indicates that the water contained in the upper portion 136 of the tank 106 is below an upper portion threshold temperature setting 160 that is accessible by the controller 152. The upper portion threshold temperature setting 160 may be set using a suitable thermostat or a setting contained in memory that is accessible by the controller 152, for example. After the water in the upper portion 136 is heated to the upper portion threshold temperature setting 160, the controller 152 may direct the valving 150 to the second setting to heat the water contained in the lower portion 138 using the lower condenser 132, until the temperature indicated by the lower temperature signal 159 indicates that the water in the lower portion 138 has reached a lower portion threshold temperature setting 162. As with the setting 160, the lower portion threshold temperature setting 162 may be provided by a lower thermostat, or a setting contained in memory that is accessible by the controller 152, for example. When the temperature of the water contained in the upper portion 136 and the lower portion 138 meets the corresponding upper portion threshold temperature setting 160 and the lower portion threshold temperature setting 162, the controller 152 may shut down the heat pump 102.

As hot water is drawn from the top or upper portion 136 of the tank 106 through the hot water outlet 107B, cold water is delivered to the bottom portion 138 of the tank 106 through the cold water inlet 107A. Eventually, the cold water mixes with the hot water contained in the lower portion 138 and lowers the temperature of the water contained in the lower portion 138 below the lower portion threshold temperature setting 162. The controller 152 then responds by setting the valving 150 in the second setting and activating the heat pump 102 (if necessary) to drive the heated fluid flow 110 from the output 114 of the heat pump 102 through the lower condenser 132 and heat the water in the lower portion 138, until the temperature of the water in the lower portion 138 reaches the lower portion threshold temperature setting 162. If enough cold water is drawn through the inlet 107A of the tank 106 to cool the water contained in the upper portion 136 below the upper threshold temperature setting 160, the controller 152 directs the valving 150 to the first setting, and the heated fluid flow 110 is directed through the upper condenser 130 to heat the water in the upper portion 136 until it reaches the temperature setting 160.

In some embodiments, unlike conventional heat pump water heaters, the water heater 100 does not include an electric water heating element that is configured to heat the water contained in the interior cavity 104 of the tank 106. As used herein, an electric water heating element includes resistive heating elements and the like whose primary function is to generate heat for heating water contained in the interior cavity 104 of the tank 106 using electrical energy, such as in response to a detected temperature of the water contained in the tank 106. As a result, some embodiments of the water heater 100 only utilize the heated fluid flow 110 as the primary source of heat to heat the water contained in the tank 106.

Figure 2:
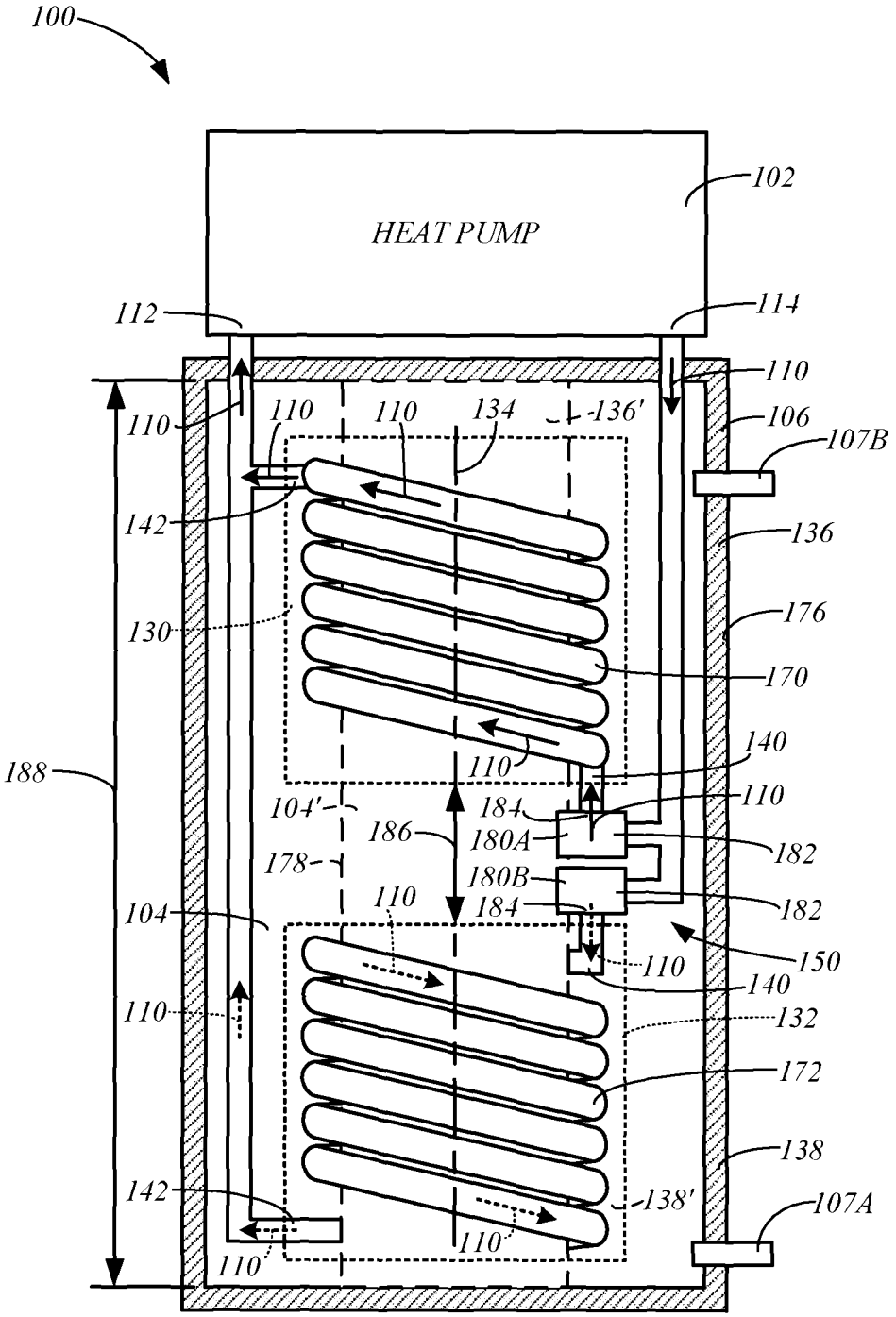
FIG. 2 is a simplified diagram of a heat pump water heater, in accordance with embodiments of the present disclosure.

FIG. 2 is a simplified diagram of a heat pump water heater 100 formed in accordance with embodiments of the present disclosure. Elements such as the controller 152, components of the heat pump 102, the temperature sensors 156 and 158, etc. shown in FIG. 1 are not shown in FIG. 2 in order to simplify the illustration. However, it is understood that one or more of the embodiments described above could be combined with the water heater 100 of FIG. 2.

As mentioned above, the condensers 130 and 132 may include tubing through which the fluid flow 110 travels to transfer heat from the fluid flow 110 to the water contained in the cavity 104 of the tank 106. One example of this is shown in FIG. 2, in which the condenser 130 includes a tubing section 170 and a condenser 132 includes a tubing section 172. The tubing sections 170 and 172 each have the input port 140 and the output port 142. As the fluid flow 110 travels through the section of tubing 170 of the upper condenser 130, heat is transferred between the tubing 110 and the water contained in the upper portion 136 of the tank 106, and when the fluid flow 110 travels through the tubing section 172 of the lower condenser 132, heat is transferred between the fluid flow 110 and the water contained in the lower portion 138 of the tank 106.

Additionally, when the interior cavity 104 is defined by an exterior wall 176, such as a tubular wall that is coaxial with the central axis, the tubing sections 170 and 172 may be immersed within the water contained in the interior cavity 104, as indicated in FIG. 2. Alternatively, the tank 106 may include an exterior wall 178 (phantom lines), such as a tubular wall that is coaxial to the central axis 104, that defines an interior cavity 104' that is connected to the input port 107A and the output port 107B. The wall 176 may operate as a housing for insulation, for example. In this configuration, the wall 178 may be encircled by the tubing sections 170 and 172 of the condensers 130 and 132, which respectively operate to heat water contained in the upper portion 136' and the lower portion 138' of the interior cavity 104' through the wall 178.

The valving 150 may take on any suitable form. One exemplary embodiment of the valving 150 is shown in FIG. 2. Here, the valving 150 includes a valve 180A and 180B, each of which includes a valve input 182 that is fluidically coupled to the output 114 of the heat pump 102, and an output 184. The output 184 of the valve 180A is fluidically coupled to the input port 140 of the output condenser 130, such as the input port 140 of the tubing section 170. Likewise, the output 184 of the valve 180B is fluidically coupled to the input port 140 of the lower condenser 132, such as the input port 140 of the tubing section 172. When the valving 150 is in the first setting, the input 182 and the output 184 of the valve 180A are fluidically coupled together to allow the fluid flow 110 to travel from the output 114 of the heat pump through the upper condenser 130, and the input 182 and the output 184 of the valve 180B are fluidically disconnected from each other, which fluidically disconnects the output 114 of the heat pump 102 to the lower condenser 132. When the valving 150 is in the second setting, the settings of the valves 180A and 180B are reversed such that the input 182 and the output 184 of the valve 180B are fluidically connected to fluidically connect the output 114 of the heat pump 102 to the input port 140 of the lower condenser 132, and the input 182 and the output 184 of the valve 180A are fluidically disconnected to fluidically disconnect the output 114 of the heat pump 102 to the input port 140 of the upper condenser 130. In one embodiment, the valving 150 includes a third setting, in which the inputs 182 and the outputs 184 of the valves 180A and 180B are fluidically disconnected to prevent the fluid flow 110 from circulating through both the upper condenser 130 and the lower condenser 132. These settings for the valves 180A and 180B may be controlled by the controller 152 (FIG. 1).

As a result, when the valving 150 is in the first setting, the heated fluid flow 110 travels from the output 114 of the heat pump 102 through the valve 180A and through the upper condenser 130, such as the tubing section 170, and is discharged through the port 142 of the condenser 130 and returned to the inlet 112 of the heat pump 102. The fluid flow 110 is prevented from flowing through the lower condenser 132, such as the tubing section 172, when the valving 150 is in the first setting due to the closing of the valve 180B. When the valving 150 is in the second setting, the valve 180A is closed and the valve 180B is opened to allow the heated fluid flow 110 to travel from the output 114 of the heat pump 102 to the input 140 of the lower condenser 132, through the lower condenser 132, such as through the tubing section 172, discharged through the output 142 of the condenser 132, and returned to the input 112 of the heat pump 102. The fluid flow 110 is prevented from flowing through the upper condenser 130 when the valving 150 is in the second setting due to the closed valve 180A. Accordingly, water contained in the upper portion 136 of the tank 106 is heated by the fluid flow 110 traveling through the upper condenser 130 when the valving 150 is in the first setting, and water contained in the lower portion 138 of the tank 106 is heated by the fluid flow 110 (dashed arrows) traveling through the lower condenser 132 when the valving 150 is in the second setting.

In some embodiments, the upper condenser 130 and the lower condenser 132 are displaced from each other along the central axis 134 by a gap 186, as shown in FIGS. 1 and 2. In some embodiments, the gap 186 has a length that is greater than one half of a length 188 (FIG. 2) of the interior cavity 104 measured along the central axis 134, greater than one-third of the length 188, greater than one-quarter of the length 188, or greater than one-eighth of the length 188. In some embodiments, the gap 186 ranges from 0-12 inches.

Figure 3:
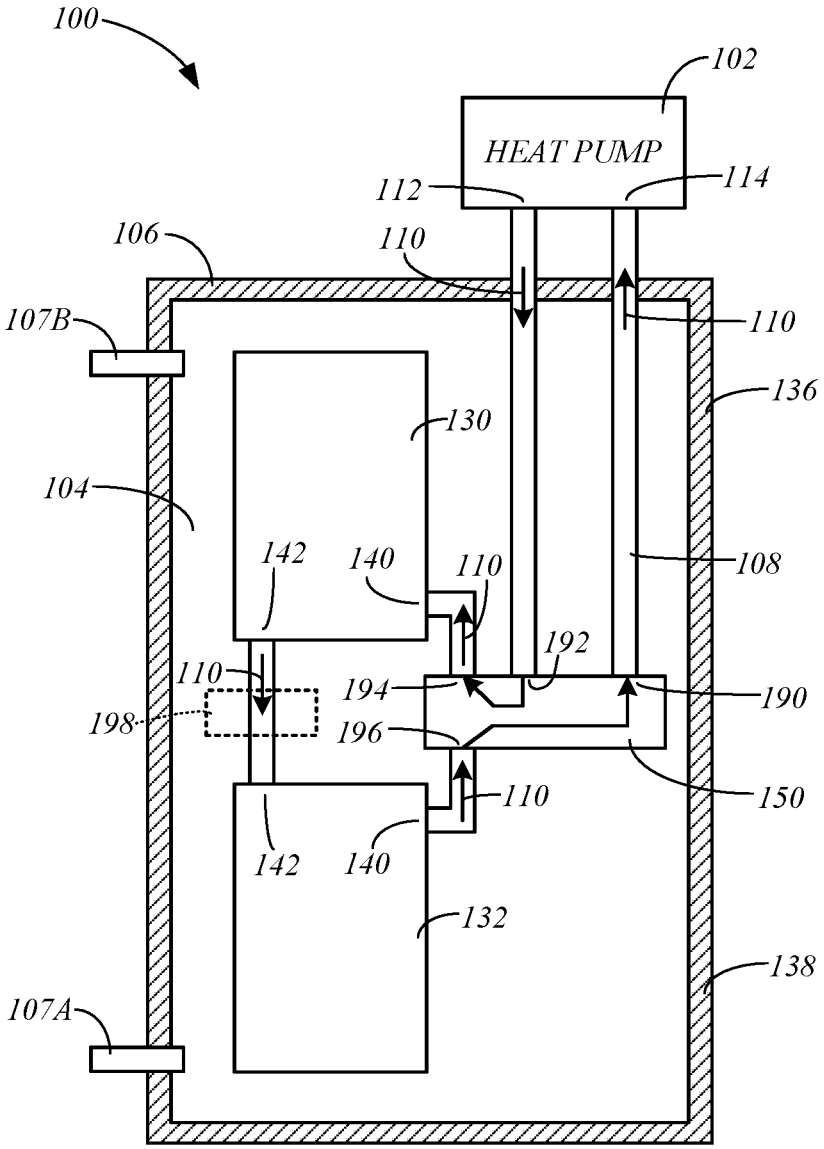
FIGS. 3 and 4 are simplified diagrams of a heat pump water heater in accordance with embodiments of the present disclosure, respectively during upper and lower heating configurations.
Figure 4:
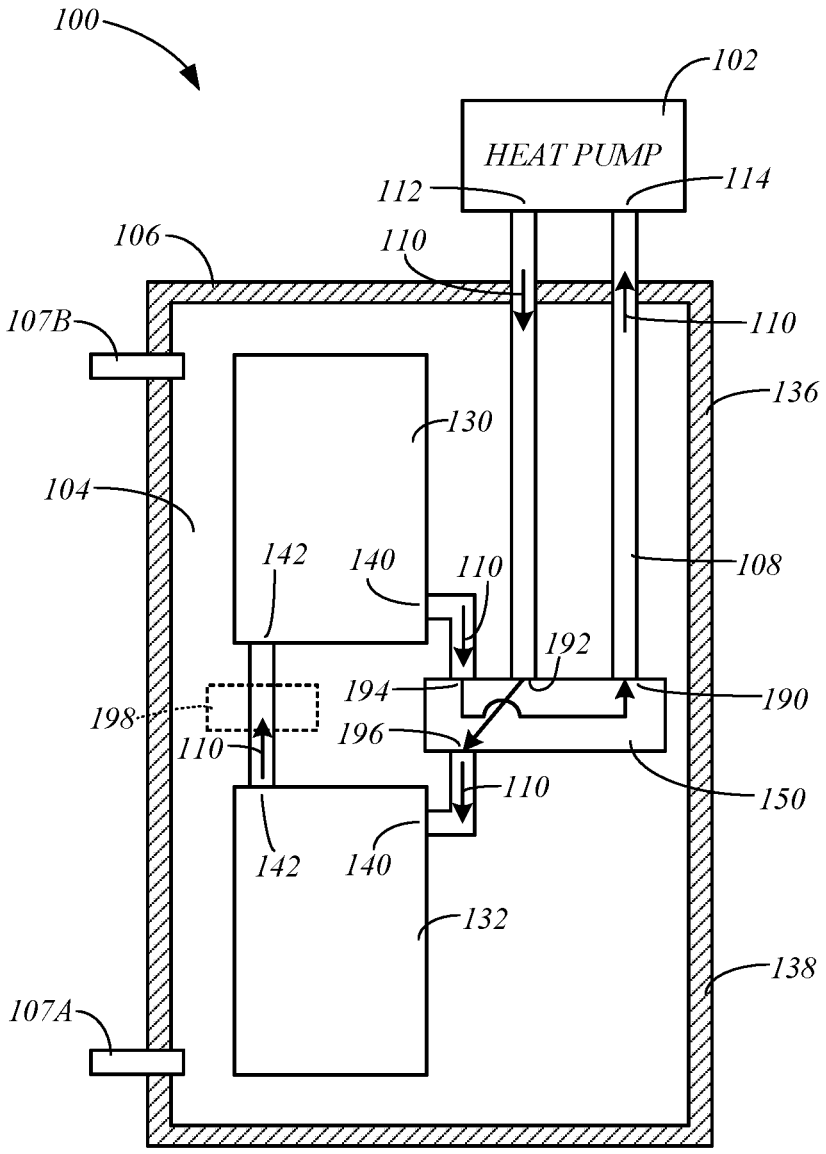

FIGS. 3 and 4 are simplified diagrams of a heat pump water heater 100 formed in accordance with embodiments of the present disclosure respectively during upper and lower heating configurations. Elements such as the controller 152, components of the heat pump 102, the temperature sensors 156 and 158, etc. shown in FIG. 1 are not shown in FIGS. 3 and 4 in order to simplify the illustrations. However, it is understood that one or more of the embodiments described above could be combined with the water heater 100 of FIGS. 3 and 4.

In some embodiments, the ports 142 of the condensers 130 and 132 are fluidically connected together. The controller 152 (FIG. 1) is configured to direct the valving 150 to a first setting corresponding to the upper heating configuration, in which the output 114 of the heat pump 102 is connected to the port 140 of the upper condenser 130, and connects the input 112 of the heat pump 102 to the port 140 of the lower condenser 132. As a result, when the water heater 100 is in the upper heating configuration, the fluid flow 110 is first circulated through the upper condenser 130, then circulated through the lower condenser 132, and returned to the heat pump 102, as indicated in FIG. 3. Accordingly, when operating in the upper heating configuration, more heat may be transferred to the water contained in the upper portion 136 of the tank 106 from the condenser 130 than that transferred to the water contained in the lower portion 138 of the tank 106 from the lower condenser 132.

The controller 152 (FIG. 1) is configured to direct the valving 150 to a second setting corresponding to the lower heating configuration, in which the output 114 of the heat pump 102 is connected to the port 140 of the lower condenser 132, and connects the input 112 of the heat pump 102 to the port 140 of the upper condenser 130. As a result, when the water heater 100 is in the lower heating configuration, the fluid flow 110 travels in the opposite direction than when the water heater is in the upper heating configuration. Thus, when the water heater is in the lower heating configuration, the fluid flow 110 is first circulated through the lower condenser 132, then circulated through the upper condenser 130, and returned to the heat pump 102, as indicated in FIG. 4. Accordingly, when operating in the lower heating configuration, more heat may be transferred to the water contained in the lower portion 138 of the tank 106 from the condenser 132 than that transferred to the water contained in the upper portion 136 of the tank 106 from the upper condenser 130.

The valving 150 may take on any suitable form to provide the desired settings for placing the water heater 100 in the upper heating configuration (FIG. 3) or the lower heating configuration (FIG. 4). Thus, the valving 150 may comprise a multi-port valve, or separate valves that may be actuated by the controller 152 to provide the desired heating configuration.

In some embodiments, the valving 150 includes an input port 190 that is fluidically coupled to the output 114 of the heat pump 102 and an output port 192 that is fluidically coupled to the input 112 of the heat pump 102, as shown in FIGS. 3 and 4. Additionally, the valving 150 includes a port 194 that is fluidically coupled to the port 140 of the upper condenser 130, and a port 196 that is fluidically coupled to the port 140 of the lower condenser 132. The valving 150 includes a first setting (FIG. 3) corresponding to the upper heating configuration, in which the port 190 is fluidically coupled to the port 194, and the port 196 is fluidically coupled to the port 192, as indicated in FIG. 3. As a result, when the valving is in the first setting, heated fluid flow 110 discharged through the output 114 of the heat pump 102 is directed by the valving 150 to the port 140 of the upper condenser 130, and the fluid flow 110 discharged through the port 140 of the lower condenser 132 is directed to the input 112 of the heat pump 102. This allows the fluid flow to first circulate through the upper condenser 130 and then through the lower condenser 132 before the fluid flow 110 is returned to the heat pump 102, in accordance with the upper heating configuration of the water heater 100.

The valving 150 also includes a second setting corresponding to the lower heating configuration (FIG. 4) of the water heater 100, in which the port 190 is fluidically coupled to the port 196, and the port 192 is fluidically coupled to the port 194. This allows the heated fluid flow 110 discharged through the output 114 of the heat pump 102 to first travel through the lower condenser 132 and then through the upper condenser 130 before it is returned to the heat pump 102, in accordance with the lower heating configuration of the water heater 100.

In some embodiments, the heat pump water heater 100 includes a valve 198, which is shown in phantom lines in FIGS. 3 and 4, that is positioned between the ports 142 of the condensers 130 and 132. The valve 198 may be configured to direct the fluid flow 110 back to the input port 114 of the heat pump 102. Thus, the valve 198 provides the option of bypassing the secondary condenser (e.g., condenser 132 in FIG. 3, and condenser 130 in FIG. 4) with the fluid flow 110. Thus, the valve 198 allows the water heater 100 to operate similarly to the arrangements shown in FIGS. 1 and 2, for example.

In some embodiments, the water heater 100 includes one or more pumps for driving the fluid flow 110. Such pumps may be used to replace and/or supplement the valving 150.

Figure 5:
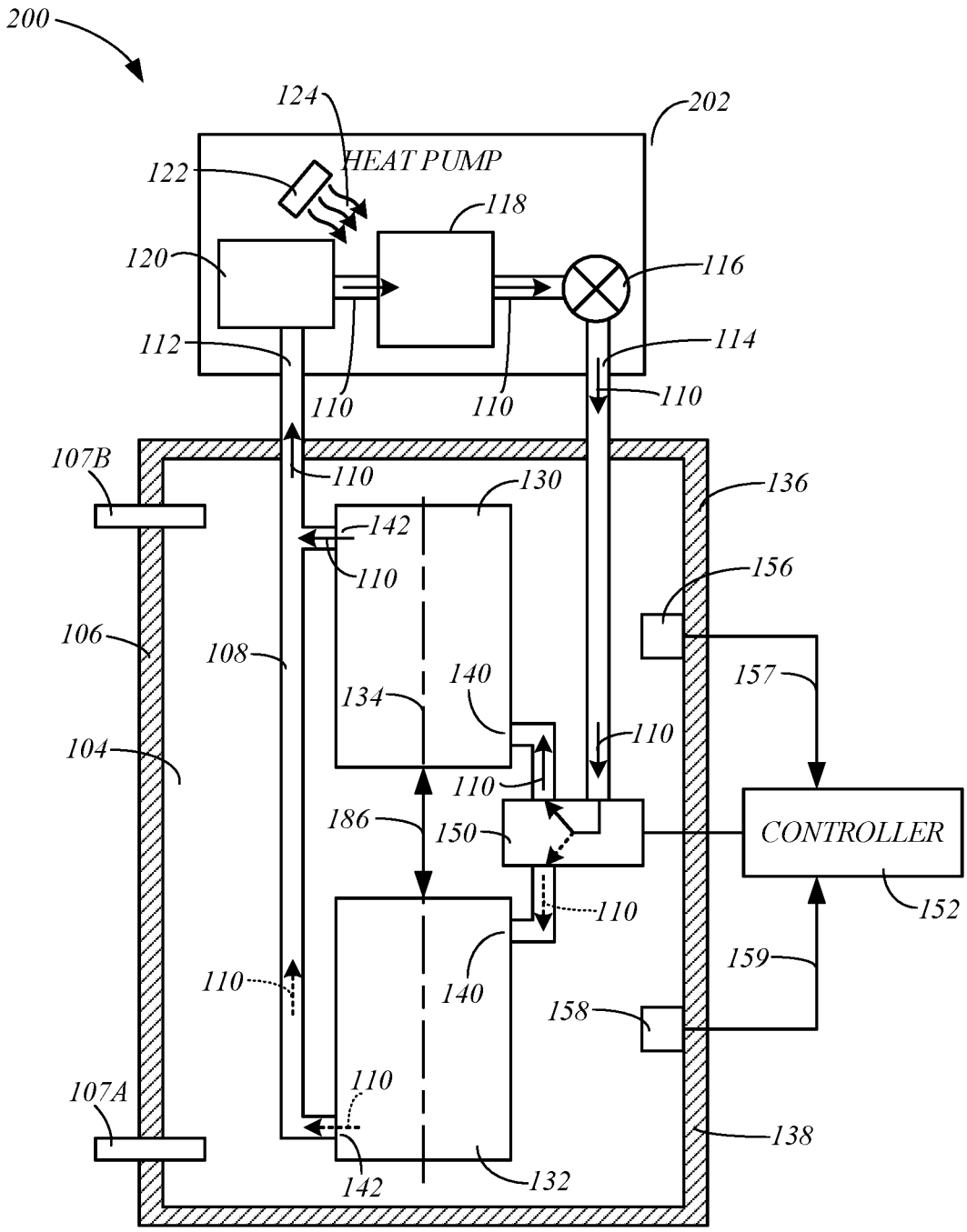
FIG. 5 is a simplified diagram of an exemplary heat pump water cooler, in accordance with embodiments of the present disclosure.

Some embodiments of the present disclosure are directed to a water cooler 200, an example of which is illustrated in FIG. 5. The water cooler 200 operates similarly to the water heater 100 and may utilize the same components as the water heater 100 (as shown), except that water cooler 200 utilizes a heat pump 202 that is configured to cool the refrigerant before it is circulated through the closed circuit 108 as the fluid flow 110. Thus, the heat pump 202 receives the fluid flow 110 in a relatively hot state (e.g., vaporized state) at an input 112 and discharges the fluid flow 110 in a relatively cooled state (e.g., liquid state) through an output 114. The cooled fluid flow 110 travels through the interior cavity 104 to cool the water contained therein.

In some embodiments, the heat pump 202 of the water cooler 200, like the heat pump 102 of the water heater 100, includes the expansion valve 116, the evaporator 118 and the compressor 120. However, these components are arranged in reverse order. Thus, the compressor 120 compresses the vaporized fluid flow 110 received through the input 112 to further heat the fluid flow 110. A fan 122 may pass ambient air 124 over the evaporator 118 to transfer heat from the fluid flow 110, which may transition to a liquid state. The fluid flow 110 then travels to the expansion valve 116, which reduces the pressure and further cools the fluid flow 110. The fluid circuit 108 delivers the cold fluid flow 110 from the output 114 through the interior cavity 104 of the tank 106 where it is used to cool the water contained therein.

This cooling process may proceed in accordance with one or more of the embodiments described above, but with the focus on cooling the water contained in the cavity 104 rather than heating it. Thus, the water cooler 200 may utilize the condensers 130 and 132 described above, which operate as evaporators in the cooling cycle. Additionally, the fluid flow 110 may be controlled in accordance with one or more of the embodiments described above to facilitate the cooling of the water in the cavity 104. For example, the controller 152 may control the valving 150 to deliver the fluid flow 110 to the one or more evaporators 130, generally in accordance with the embodiments described above with reference to FIGS. 1-4.

Although the embodiments of the present disclosure have been described with reference to preferred embodiments, workers skilled in the art will recognize that changes may be made in form and detail without departing from the spirit and scope of the present disclosure.

What is claimed is:

1. A heat pump water heater comprising:

a tank including an input port, through which water is input to an interior cavity of the tank, and an output port, through which water is discharged from the interior cavity;

a first condenser configured to heat an upper portion of the interior cavity, wherein the first condenser includes first and second ports;

a second condenser configured to heat a lower portion of the interior cavity, wherein the second condenser includes a first port, and a second port, which is fluidically coupled to the second port of the first condenser;

a heat pump configured to drive a fluid in a heated state through a heat pump output and receive the fluid through a heat pump input;

valving having a first valve setting, in which the heat pump output is fluidically coupled to the first port of the first condenser and is fluidically disconnected from the first port of the second condenser, and the heat pump input is fluidically coupled to the first port of the second condenser, and a second valve setting, in which the heat pump output is fluidically coupled to the first port of the second condenser and is fluidically disconnected from the first port of the first condenser, and the heat pump input is fluidically connected to the first port of the first condenser; and a controller configured to selectively direct the valving to the first or second valve setting, wherein:

when the valving is in the first valve setting the fluid is driven from the heat pump output to the first port of the first condenser, from the first port of the first condenser through the first condenser to the second port of the first condenser, from the second port of the first condenser to the second port of the second condenser, from the second port of the second condenser through the second condenser to the first port of the second condenser, and from the first port of the second condenser to the heat pump input; and when the valving is in the second valve setting the fluid is driven from the heat pump output to the first port of the second condenser, from the first port of the second condenser through the second condenser to the second port of the second condenser, from the second port of the second condenser to the second port of the first condenser, from the second port of the first condenser through the first condenser to the first port of the first condenser, and from the first port of the first condenser to the heat pump input.

2. The heat pump water heater of claim 1, wherein:

the water heater includes:

a first temperature sensor configured to generate a first temperature signal indicative of a temperature of water contained in the upper portion of the interior cavity; and/or a second temperature sensor configured to generate a second temperature signal indicative of a temperature of water contained in the lower portion of the interior cavity; and the controller directs the valving to the first or second valve setting based on at least one of the first and second temperature signals.

3. The heat pump water heater of claim 2, wherein:

the valving comprises a valve having the first and second valve settings, a valve input fluidically coupled to the heat pump output, a valve output fluidically coupled to the heat pump input, a first port fluidically coupled to the first port of the first condenser, and a second port fluidically coupled to the first port of the second condenser;

the valve input is fluidically coupled to the first port and the valve output is fluidically coupled to the second port when the valve is in the first valve setting; and the valve input is fluidically coupled to the second port and the valve output is fluidically coupled to the first port when the valve is in the second valve setting.

4. The heat pump water heater of claim 3, wherein the first condenser comprises a first tubing section having the first and second ports, and the second condenser comprises a second tubing section having the first and second ports.

5. The heat pump water heater of claim 4, wherein:

the tank includes an exterior wall surrounding the interior cavity; and the first and second tubing sections each encircle the exterior wall.

6. The heat pump water heater of claim 5, wherein the first and second tubing sections are contained within the interior cavity.

7. The heat pump water heater of claim 4, wherein:

the tank comprises a tubular wall having a central axis;

the first and second tubing sections are displaced from each other along the central axis by a gap; and the gap extends over a distance selected from the group consisting of greater than one-half a length of the interior cavity measured along the central axis, greater than one-third of the length of the interior cavity, greater than one-fourth of the interior cavity and greater than one-eighth of the length of the interior cavity.

8. The heat pump water heater of claim 2, wherein the heat pump water heater does not include an electric water heating element configured to heat water contained in the interior cavity of the tank.

* * * * *